US005405145A

United States Patent [19]

Jones et al.

[11] Patent Number: 5,405,145

[45] Date of Patent: Apr. 11, 1995

[54] DICE GAME WITH WILD DIE

[76] Inventors: Albert C. Jones; Doris C. Ewens, both of Box 104 Red Bud Pl., Lenoir, N.C. 28645

[21] Appl. No.: 288,026

[22] Filed: Aug. 10, 1994

[51] Int. Cl.[6] ..... A63F 9/04

[52] U.S. Cl. ..... 273/146; 273/268

[58] Field of Search ..... 273/268, 272, 299, 274, 273/146, 145 R, 145 A, 145 B, 145 C, 145 CA, 145 D, 145 E

[56] References Cited

U.S. PATENT DOCUMENTS

| | | | |
|---|---|---|---|
| 2,766,987 | 10/1956 | Seelbrede et al. | 273/272 |
| 3,608,905 | 9/1971 | Edison | 273/146 |
| 4,834,386 | 5/1989 | Rosenthal et al. | 273/146 |
| 4,930,780 | 6/1990 | Goodman et al. | 273/146 |
| 5,125,660 | 6/1992 | Stahl | 273/146 |

*Primary Examiner*—Vincent Millin
*Assistant Examiner*—William M. Pierce

[57] ABSTRACT

A dice game for allowing two or more players to compete against each other comprising seven plastic cube-shaped dice each having six faces, six of the dice bearing numeric indicia with each dice having its faces marked from 1 to 6 respectively, the remaining die having one of its faces marked with the letter "W" defined as "wild" and the other five faces unmarked; a cup for receiving, shaking, and throwing the dice therefrom; a rectangular dice box having a bottom wall and four side walls extended upwards about its periphery to define a playing space for throwing the dice thereon; and a score sheet for tallying a player's score based upon throws of the dice.

4 Claims, 3 Drawing Sheets

DICE GAME WITH WILD DIE

BACKGROUND OF THE INVENTION

1. Field of the Invention

The present invention relates to a dice game and more particularly pertains to allowing two or more players to compete against each other with a dice game.

2. Descritpion of the Prior Art

The use of dice games is known in the prior art. More specifically, dice games heretofore devised and utilized for the purpose of allowing players to compete against each other are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 262,726 to Rice discloses game dice. U.S. Pat. No. 3,905,603 to Hoetzel discloses a dice game. U.S. Pat. No. 4,834,386 to Rosenthal et al. discloses a dice game. U.S. Pat. No. 4,930,780 to Goodman et al. discloses a dice game. U.S. Pat. No. 5,133,559 to Page discloses a casino dice game.

While these devices fulfill their respective, particular objective and requirements, the aforementioned patents do not describe a dice game that allows players to compete against each other using six numbered dice and one specially marked die having one face designated as "wild" for combining with the other six dice for obtaining a score.

In this respect, the dice game according to the present invention substantially departs from the conventional concepts and designs of the prior art, and in doing so provides an apparatus primarily developed for the purpose of allowing two or more players to compete against each other.

Therefore, it can be appreciated that there exists a continuing need for new and improved dice game which can be used for allowing two or more players to compete against each other. In this regard, the present invention substantially fulfills this need.

SUMMARY OF THE INVENTION

In the view of the foregoing disadvantages inherent in the known types of dice games now present in the prior art, the present invention provides an improved dice game. As such, the general purpose of the present invention, which will be described subsequently in greater detail, is to provide a new and improved dice game and method which has all the advantages of the prior art and none of the disadvantages.

To attain this, the present invention essentially comprises the following steps of: providing seven plastic cube-shaped dice each having six faces, six of the dice bearing numeric indicia with each dice having its faces marked 1 to 6 respectively, the remaining die having one of its faces marked with the letter "W" defined as "wild" and the other five faces unmarked; providing a cup for receiving, shaking, and throwing the dice therefrom; providing a rectangular dice box having a bottom wall and four side walls extended upwards about its periphery to define a playing space for throwing the dice thereon; providing a score sheet for tallying a player's score based upon throws of the dice; establishing an initial order of play where players are designated as the first player, second player, and so on to a last player; initiating play by throwing the dice and playing in turn beginning with the first player and ending with the last player and with a score of 750 points starting the game, whereupon each player in turn throws the dice in an attempt to achieve a score of 25,000 to be declared a winner; and wherein points are accumulated through a throw and may be lost when the player elects to throw again or kept when the player declines to throw again; wherein a throw of three of a kind resulting in three 1's accumulates 1000 points, three 2's accumulates 200 points, three 3's accumulates 300 points, three 4's accumulates 400 points, three 5's accumulates 500 points, and three 6's accumulates 600 points; wherein a "wild" can be combined with a throw resulting in two of a kind to thereby be designated as a throw resulting in three of a kind; wherein a "wild" can be combined with any throw resulting in three of a kind to thereby double the points attained on the throw; wherein a "wild" can be combined with the other dice only once in any given throw; wherein a throw resulting in three of a kind with any 1's and 5's is designated as a "full house"; wherein a player who throws a "full house" is entitled to at least one "free" throw with the points accumulated through the throw of the "full house" and "free" throw kept by a player, and with the player allowed to pick up dice not a part of the "full house" for the "free" throw at his discretion; wherein a throw containing a 1 or a 5 allows a player to elect or decline to take an "extra" throw of the dice with a player electing to take an "extra" throw allowed to pick up any of the dice at his discretion except one dice showing a 1 or a 5; wherein a player not obtaining at least one 1 or at least one 5 on an "extra" throw loses points accumulated during his turn and with play being transferred to the next player; and wherein play is transferred to the next player when a player throws dice whose points total less than a threshold of 550.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dice game which has all the advantages of the prior art dice games and none of the disadvantages.

It is another object of the present invention to provide a new and improved dice game which may be easily and efficiently manufactured and marketed.

It is a further object of the present invention to provide a new and improved dice game which is of durable and reliable construction.

An even further object of the present invention is to provide a new and improved dice game which is susceptible of a low cost of manufacture with regard to both materials and labor, and which accordingly is then susceptible of low prices of sale to the consuming public, thereby making such a dice game economically available to the buying public.

Still yet another object of the present invention is to provide a new and improved dice game which provides in the apparatuses and methods of the prior art some of the advantages thereof, while simultaneously overcoming some of the disadvantages normally associated therewith.

Even still another object of the present invention is to provide a new and improved dice game for allowing two or more players to compete against each other.

Lastly, it is an object of the present invention to provide a new and improved dice game comprising seven plastic cube-shaped dice each having six faces, six of the dice bearing numeric indicia with each dice having its faces marked from 1 to 6 respectively, the remaining die having one of its faces marked with the letter "W" defined as "wild" and the other five faces unmarked; a cup for receiving, shaking, and throwing the dice therefrom; a rectangular dice box having a bottom wall and four side walls extended upwards about its periphery to define a playing space for throwing the dice thereon; and a score sheet for tallying a player's score based upon throws of the dice.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the .same parts through the various Figures.

DESCRIPTION OF THE PREFERRED EMBODIMENT

Figure 1:
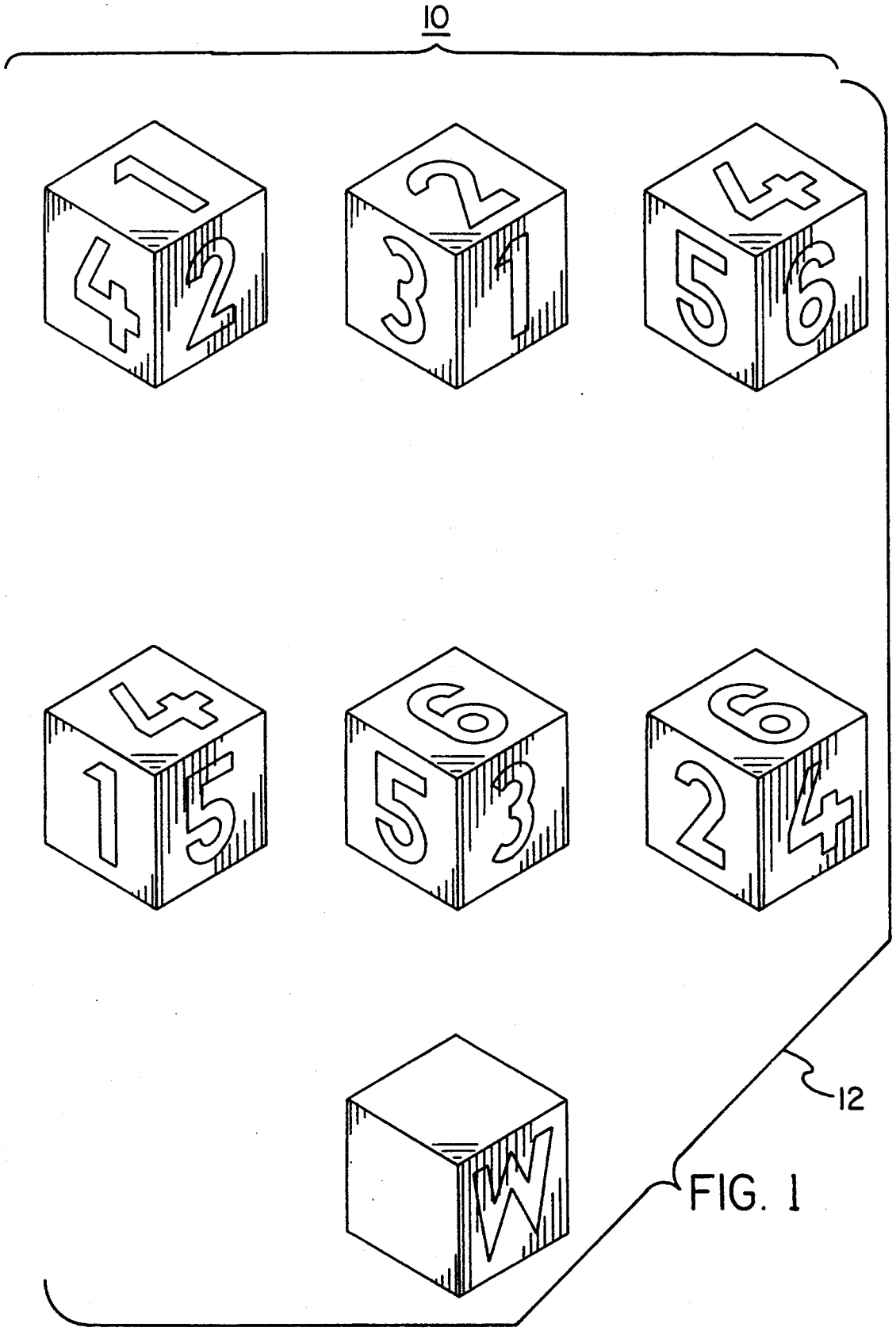
FIG. 1 is a perspective view of the dice of the present invention.
Figures 2, 3:
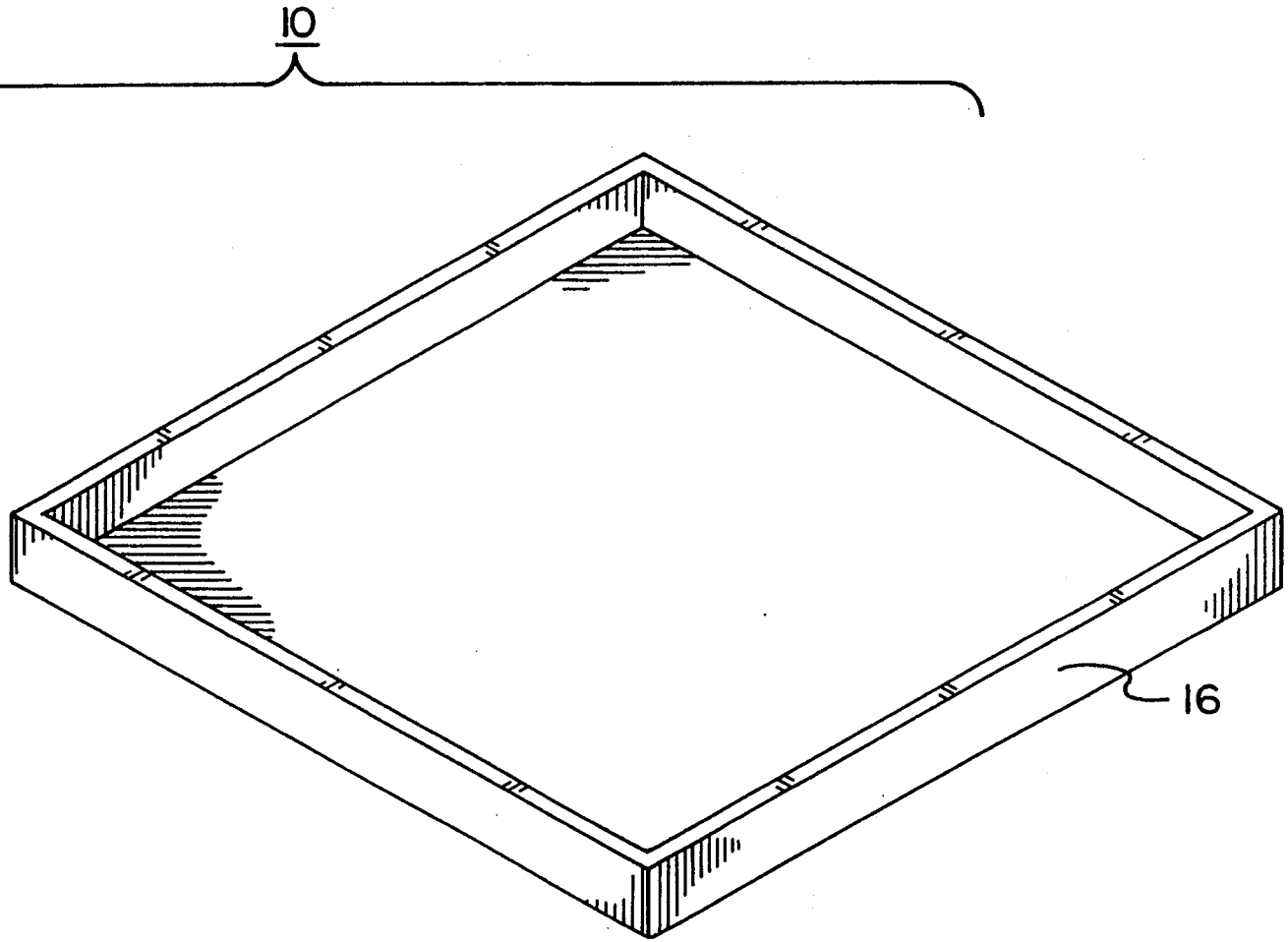
FIG. 2 is a perspective view of the cup used for shaking and throwing the dice of the present invention.
FIG. 3 is a perspective view of the dice box used for receiving the dice thrown from the cup.
Figure 4:
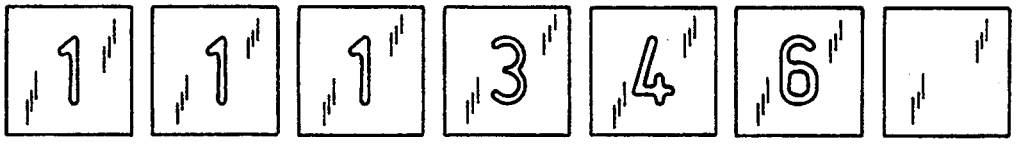
FIG. 4 shows a throw of the dice by a player with a score value of 1000 points, that is, three 1's (1, 1, 1). Since the player rolled a 1, he has an option of rolling again. If he decides to roll again, he may pick up all the dice except one showing a 1. If he rolls again and doesn't get a 1 or a 5 or a "wild", he loses his turn and points accumulated during the turn. Play then passes to the next player.
Figure 5:
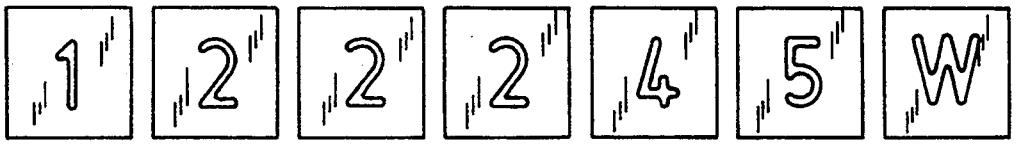
FIG. 5 shows a throw of the dice by a player representing a "full house". In this case, the player is entitled to a "free" roll. He may pick up the dice numbered 4 , 5 or "wild" and roll again.
Figure 6:
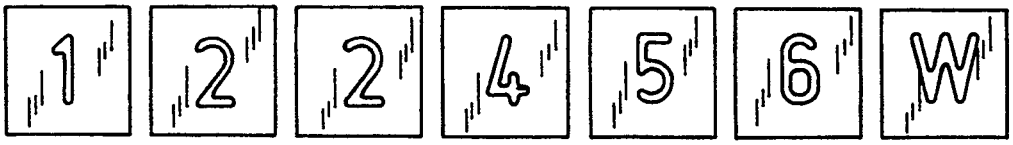
FIG. 6 shows a throw of the dice by a player with a score value of 600 points that is, three 6's (6, 6, "wild").
Figure 7:
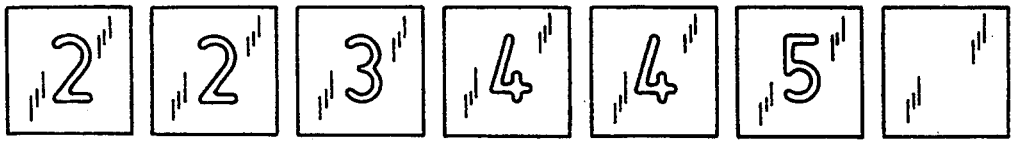
FIG. 7 shows a throw of the dice by a player worth no points.
Figure 8:
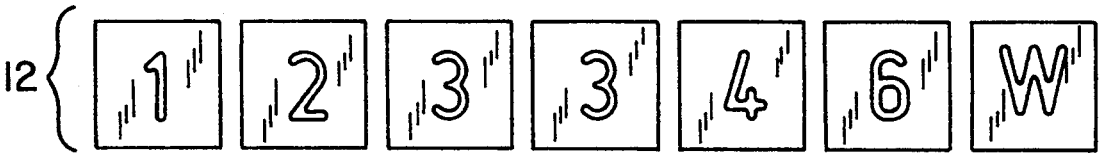
FIG. 8 shows a .throw of the dice by a player with a score value of 300 points that is, three 3's (3, 3, "wild").

With reference now to the drawings, and in particular, to FIG. 1 thereof, the preferred embodiment of the new and improved dice game embodying the principles and concepts of the present invention and generally designated by the reference number 10 will be described.

Specifically, the present invention essentially includes four major components. The major components are the dice, cup, dice box, and score sheet. These components are interrelated to provide the intended function.

More specifically, it will be noted in the various Figures that the first major component is the dice 12. The present invention includes seven plastic and cube-shaped dice. Each dice has six faces. All faces of the dice are red. Six of the dice bear white numeric indicia with each dice having its faces marked 1 to 6 respectively. The remaining die has one of its faces marked with the white letter "W" defined as "wild". The other five faces of the remaining die are unmarked.

The second major component is the cup 14. The cup is rigid in structure. The is used for holding, shaking, and throwing the dice therefrom. It is not required that the cup be utilized for performing these functions. These functions can also be performed by hand.

The third major component is the dice box 16. The dice box is rectangular and rigid in structure. It has a bottom wall and four side walls extended upwards about its periphery to define a playing space. This playing space is adapted to receive dice thrown thereon. It is not required that the dice box be utilized. Any generally level and hard playing surface will suffice.

The fourth major component is the score sheet. The score sheet is used for tallying a player's score based upon throws of the dice. Other scoring mechanisms can be used in lieu of the scoring sheet, like a chalkboard.

The rules of the game of the present invention will now be explained. An initial order of play is first established where players are designated as the first player, second player, and so on to a last player. This initial order of play is established by having each player, in turn, throw one die to see who goes first. The player with the highest throw goes first with subsequent players to the left or right following based upon the discretion of the first player.

At the beginning of each player's turn, play is initiated by throwing the dice. Points are accumulated based upon the throw of the dice. A player must achieve 750 points to start the game. If a player does not attain 750 points, play is transferred to the next player. Once a player achieves 750 points, the game is started. With the game now started, a player must throw dice during his turn totaling more that 550 points. If a player's turn results in an accumulation of points less than a threshold of 550, play is transferred to the next player. Accumulated point values other than 550 may be used as a threshold. Each player in turn throws the dice in an attempt to achieve a score of 25,000. When a player is the first to meet or exceed the score of 25,000, he is declared a winner. The winning score may also be set as desired.

Throws of three of a kind result in the accumulation of points. Three 1's accumulate 1000 points, three 2's accumulate 200 points, three 3's accumulate 300 points, three 4's accumulate 400 points, three 5's accumulate 500 points, and three 6's accumulate 600 points. A single 1 showing is worth 100 points. These scores are tabulated as shown below:

| Dice Throw: | Point Value |
|---|---|
| one 1 | 100 |
| three 1's | 1000 |
| three 2's | 200 |
| three 3's | 300 |
| three 4's | 400 |
| three 5's | 500 |
| three 6's | 600 |

A "wild" can be combined with a throw resulting in two of a kind to thereby be designated as a throw resulting in three of a kind with the accumulation of the noted points. For example a "wild" used with two 4's results in 400 points. Furthermore, a "wild" can be combined with any throw resulting in three of a kind to thereby double the points attained on the throw. For example, a "wild" doubles three 1's to 2000 points, and likewise for other three of a kind combinations. A "wild" combined with three 4's results in 800 points. Three of a kind only counts when a player throws them all the dice at one time. A "wild" can be combined with other dice only once in a given throw. The "wild" only counts when the "W" is thrown.

A throw resulting in a three of a kind with any 1's or 5's is designated as a "full house". A player who throws a "full house" is entitled to at least one "free" throw. The points accumulated through the throw of the "full house" and "free" throw are kept by a player. The player is allowed to pick up dice not part of the "full house" for the "free" throw at his discretion. To keep a 400 or 500 score on a "full house" a player gets a "free" roll but must get enough to make this score 550 or better to keep your 450 score. A "full house" is like a 1, three 4's and two 5's and resulting in 700 points. A player is then entitled to a "free" throw. If on this "free" throw a player elects to throw only the "wild" dice and this "wild" dice results in a "W", a player can double his score to 1400.

A throw containing a 1 or a 5 allows a player to elect or decline to take an "extra" throw of the dice. A player electing to take an "extra" throw of the dice is allowed to pick up any of the dice at his discretion except one dice showing a 1 or a 5. A player not attaining at least one 1 or at least one 5 on an "extra" throw loses points accumulated during his turn. Play is then transferred to the next player. If a player declines to throw again, he may keep the points accumulated as long as these points total more than a threshold of 550.

As an example of play, if a player throws a 1, three 5's, and a "wild", then the point value is (100+500)*2=1200 points. This player may elect to roll again to build his score (he can take an "extra" throw provided he attains a 1 or a 5 in a throw). However, if this player does not throw a 1 or a 5 in his "extra" throw, he loses the 1200 points accumulated during his turn, and play is transferred to the next player.

Provided below is an example score sheet.

Note: FH="full house".

F="free" throw. F means throw again as long as a 1 or a 5 or the "wild" comes up.

SCORESHEET

| PLAYER 1 | PLAYER 2 | |
|---|---|---|
| 750 | 1000 | 22,300 |
| 800 | FH 2600 | F 450 |
| 1,550 | 3600 | 22,750 |
| 700 | FH 500 | 1050 |
| 2250 | 4,100 | 23,800 |
| FH 500 | 500 | FH 500 |
| 2,750 | 4600 | 24,300 |
| 600 | FH 1400 | F 200 |
| 3,350 | 6,000 | 24,500 |
| FH 500 | FH 800 | FH 850 |
| 3,850 | 6,800 | 25,350 |
| 700 | FH 500 | F 700 |
| 4,550 | 7,300 | 26,050 |
| 600 | FH 1,250 | |
| 5,150 | 8,550 | |
| 850 | 400 | |
| 6,000 | 8,950 | |
| 750 | 800 | |
| 6,750 | 9,750 | |
| 650 | 550 | |
| 7,400 | 10,300 | |
| FH 450 | FH 2,150 | |
| 7,850 | 12,450 | |
| F 600 | FH 550 | |
| 8,450 | 13,000 | |
| 2,050 | F 350 | |
| 10,500 | 13,350 | |
| FH 1,200 | 550 | |
| 11,700 | 13,900 | |
| FH 800 | 700 | |
| 12,500 | 14,600 | |
| FH 700 | FH 1150 | |
| 13,200 | 15,750 | |
| FH 300 | FH 800 | |
| 13,500 | 16,550 | |
| 1,100 | FH 800 | |
| 14,600 | 17,350 | |
| 550 | 400 | |
| 15,150 | 17,750 | |
| 1,200 | FH 400 | |
| 16,350 | 18,150 | |
| 600 | FH 800 | |
| 16,950 | 18,950 | |
| 1,100 | F 550 | |
| 18,050 | 19,500 | |
| FH 700 | 600 | |
| 18,750 | 20,100 | |
| F 500 | 900 | |
| 19,250 | 21,000 | |
| 1,050 | FH 900 | |
| 20,300 | 21,900 | |
| | FH 400 | |

-continued

| SCORESHEET | |
|---|---|
| PLAYER 1 | PLAYER 2 |
| 22,300 | |

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A method of playing a dice game with two or more players comprising the following steps:

providing seven plastic cube-shaped dice each having six faces, six of the dice bearing numeric indicia with each dice having its faces marked 1 to 6 respectively, the remaining die having one of its faces marked with the letter "W" defined as "wild" and the other five faces unmarked;

providing a cup for receiving, shaking, and throwing the dice therefrom;

providing a rectangular dice box having a bottom wall and four side walls extended upwards about its periphery to define a playing space for throwing the dice thereon;

providing a score sheet for tallying a player's score based upon throws of the dice;

establishing an initial order of play where players are designated as the first player, second player, and so on to a last player;

initiating play by throwing the dice and playing in turn beginning with the first player and ending with the last player and with a score of 750 points starting the game, whereupon each player in turn throws the dice in an attempt to achieve a score of 25,000 to be declared a winner;

wherein points are accumulated through a throw and may be lost when the player elects to throw again or kept when the player declines to throw again;

wherein a throw of three of a kind resulting in three 1's accumulates 1000 points, three 2's accumulates 200 points, three 3's accumulates 300 points, three 4's accumulates 400 points, three 5's accumulates 500 points, and three 6's accumulates 600 points;

wherein a "wild" can be combined with a throw resulting in two of a kind to thereby be designated as a throw resulting in three of a kind;

wherein a "wild" can be combined with any throw resulting in three of a kind to thereby double the points attained on the throw;

wherein a "wild" can be combined with the other dice only once in any given throw;

wherein a throw resulting in three of a kind with any 1's and 5's is designated as a "full house";

wherein a player who throws a "full house" is entitled to at least one "free" throw, with the points accumulated through the throw of the "full house" and "free" throw kept by a player and with the player allowed to pick up dice not a part of the "full house" for the "free" throw at his discretion;

wherein a throw containing a 1 or a 5 allows a player to elect or decline to take an "extra" throw of the dice with a player electing to take an "extra" throw allowed to pick up any of the dice at his discretion except one dice showing a 1 or a 5;

wherein a player not obtaining at least one 1 or at least one 5 on an "extra" throw loses points accumulated during his turn and with play being transferred to the next player; and wherein play is transferred to the next player when a player throws dice whose points total less than a threshold of 550.

2. A dice game for allowing two or more players to compete against each other comprising:

seven plastic cube-shaped dice each having six faces, six of the dice bearing numeric indicia with each dice having its faces marked from 1 to 6 respectively, the remaining die having one of its faces marked with the letter "W" defined as "wild" and the other five faces unmarked;

a cup for receiving, shaking, and throwing the dice therefrom;

a rectangular dice box having a bottom wall and four side walls extended upwards about its periphery to define a playing space for throwing the dice thereon; and a score sheet for tallying a player's score based upon throws of the dice.

3. A method of playing a dice game with two or more players comprising the following steps:

providing a plurality of dice each having six faces, at least one die having one of its faces marked specially marked and defined as "wild" and the other five faces unmarked, the remaining dice bearing numeric indicia;

establishing an initial order of play where players are designated as the first player, second player, and so on to a last player;

initiating play by throwing the dice and playing in turn beginning with the first player and ending with the last player, whereupon each player in turn throws the dice in an attempt to be the first to achieve a winning score;

wherein points are accumulated through a throw and may be lost when the player elects to throw again or kept when the player declines to throw again;

wherein a throw of at least three of a kind results in the accumulation of points;

wherein a "wild" can be combined with a throw resulting in two of a kind to thereby be designated as a throw resulting in three of a kind;

wherein a "wild" can be combined with any throw resulting in at least three of a kind to thereby increase the points attained on the throw;

wherein a "wild" can be combined with the other dice only once in any given throw; and wherein a throw resulting in at least three of a kind with any 1's and 5's is designated as a "full house";

wherein a player who throws a "full house" is entitled to at least one "free" throw, with the points accumulated through the throw of the "full house" and "free" throw kept by a player, and with the player allowed to pick up dice not a part of the "full house" for the "free" throw at his discretion;

wherein a throw containing at least one 1 or at least one 5 allows a player to elect or decline to take an "extra" throw of the dice, with a player electing to take an "extra" throw allowed to pick up any of the dice at his discretion except at least one dice showing a 1 or a 5; and wherein a player not obtaining at least one 1 or at least one 5 on an "extra" throw loses points accumulated during his turn and with play being transferred to the next player.

4. A method of playing a dice game with two or more players as set forth in claim 3 wherein a play is transferred to the next player when a player throws dice whose points do not exceed a given threshold point value.

* * * * *